US006702129B1

(12) United States Patent
Harris

(10) Patent No.: US 6,702,129 B1
(45) Date of Patent: Mar. 9, 2004

(54) EXPANDABLE CLOTHES SUPPORT STRUCTURE

(76) Inventor: Peggy R. Harris, 308 Hawthorne St., Marlton, NJ (US) 08053

( * ) Notice: Subject to any disclaimer, the term of this patent is extended or adjusted under 35 U.S.C. 154(b) by 0 days.

(21) Appl. No.: 10/265,546

(22) Filed: Oct. 7, 2002

(51) Int. Cl.[7] ..... A47F 5/00
(52) U.S. Cl. ..... 211/196; 211/33; 211/172
(58) Field of Search ..... 211/196, 205, 211/171, 172, 1.3, 85.3, 33

(56) References Cited

U.S. PATENT DOCUMENTS

| | | | | | |
|---|---|---|---|---|---|
| 768,363 | A | * | 8/1904 | Harrell | |
| 1,069,643 | A | | 8/1913 | Inden | |
| 1,587,676 | A | * | 6/1926 | Patterson | |
| 1,631,227 | A | * | 6/1927 | See | |
| 1,832,730 | A | * | 11/1931 | Pack | |
| 1,973,521 | A | | 9/1934 | Bullard | 211/172 |
| 2,126,513 | A | | 8/1938 | Sterrett | 211/97 |
| 2,284,770 | A | * | 6/1942 | Scheuer | |
| 2,469,494 | A | * | 5/1949 | Busko | |
| 2,515,661 | A | * | 7/1950 | Nitschke | |
| 2,708,324 | A | * | 5/1955 | Wedden | |
| 3,249,233 | A | | 5/1966 | Marcus et al. | 211/105.3 |
| 4,807,837 | A | * | 2/1989 | Gawlik et al. | 211/196 X |
| 5,022,617 | A | * | 6/1991 | Henderson | |
| 5,458,249 | A | * | 10/1995 | Shang-Lu | 211/196 X |

* cited by examiner

*Primary Examiner*—Robert W. Gibson, Jr.
(74) *Attorney, Agent, or Firm*—Sturm & Fix LLP

(57) ABSTRACT

An expandable clothes support structure (10) including a base member (20) provided with a top panel (24) having a hollow collar element (25) dimensioned to receive the lower end (31) of a main support post member (30) provided with a plurality of movable support units (13). Each support unit (13) includes a main support arm member (60) pivotally secured on one end (61) to the main support post member (30) and having an extension arm element (63) telescopically received in the other end (62) of the support arm member (60) such that a lip (64) on the extension arm element (63) may be disposed at different lateral distances from the main support post member.

10 Claims, 4 Drawing Sheets

Fig. 10
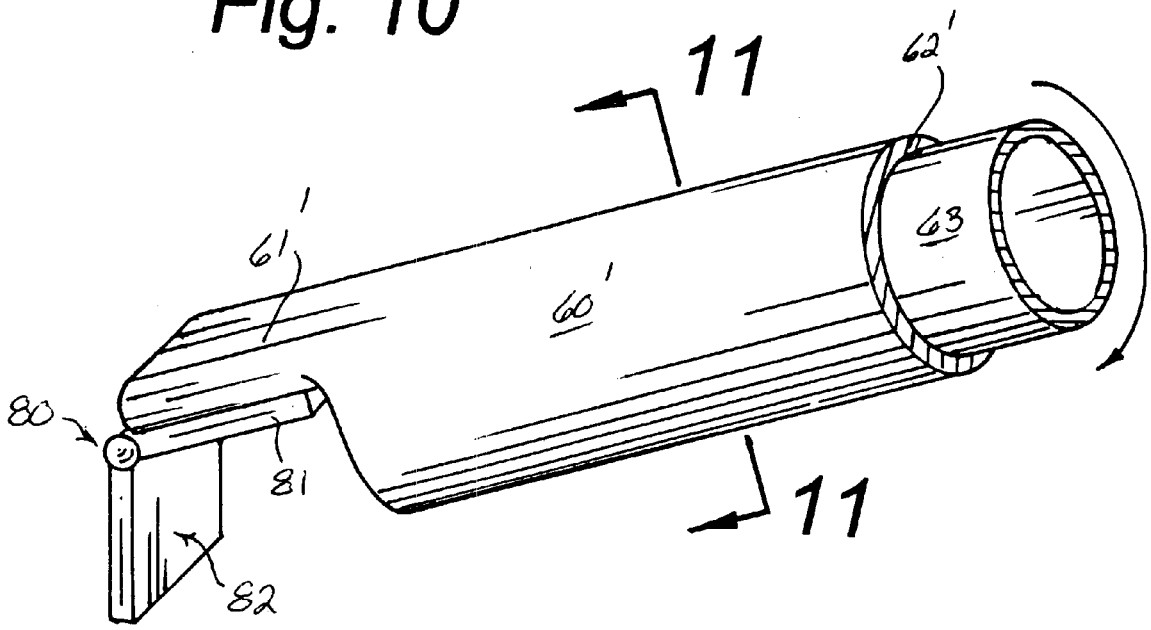
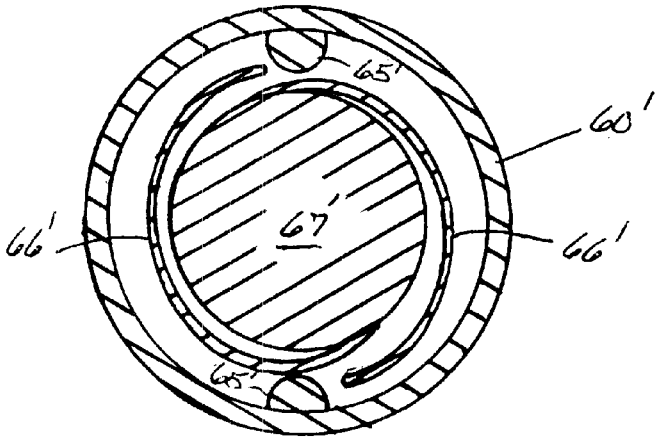
Fig. 11

EXPANDABLE CLOTHES SUPPORT STRUCTURE

BACKGROUND OF THE INVENTION

1. Field of the Invention

The present invention relates to the field of specialized support structures in general, and in particular to structures commonly referred to as clothes trees.

2. Description of Related Art

As can be seen by reference to the following U.S. Pat. Nos. 1,185,642; 1,973,521; 1,069,643; 3,249,233; and 2,126,513, the prior art is replete with myriad and diverse clothes tree constructions.

While all of the aforementioned prior art constructions are more than adequate for the basic purpose and function for which they have been specifically designed, they are uniformly deficient with respect to their failure to provide a simple, efficient, and practical clothes tree support structure that has expandable and contractible support elements that can be selectively deployed to support individual articles of clothing and retracted to their collapsed mode when not in use.

As most people who employ clothes trees are all too well aware, virtually all clothes trees have fixed length rigidly mounted support elements that project outwardly from a vertical support post and these support arms not only take up useful storage space, but also have a tendency to provide unnecessary obstructions for the user at various other times.

As a consequence of the foregoing situation, there has existed a longstanding need for a new and improved type of expandable clothes support structure whose horizontal support elements are selectively deployable for use and normally retracted otherwise, and the provision of such a construction is a stated objective of the present invention.

BRIEF SUMMARY OF THE INVENTION

Briefly stated, the expandable clothes support structure that forms the basis of the present invention comprises in general, a base unit, a vertical support unit extending upwardly from the base unit, and a plurality of movable support units provided on the vertical support unit and adapted to be selectively extended and retracted in a pivoted and telescoping fashion relative to the vertical support unit.

As will be explained in greater detail further on in the specification, the base unit comprises a weighted base member provided with an upwardly projecting hollow collar element that is dimensioned to receive the lower portion of the vertical support unit.

The vertical support unit comprises in general, a main vertical support post member having a lower end dimensioned to be received in the collar element of the base member and having an upper end provided with an adapter post element dimensioned to be received in a complementary recess formed in the lower end of an auxiliary vertical support post extension member.

In addition, both the main support post member and the auxiliary support post extension member are provided with a plurality of movable support units. Each of the movable support units includes a main support arm member pivotally attached to the vertical support post member and an extension arm element telescopically received within the main support arm member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 10 is an enlarged cut away detail view of one of the support arm units of the second version; and FIG. 11 is a cross sectional view taken through line 11—11 of FIG. 10.

DETAILED DESCRIPTION OF THE INVENTION

Figure 1:
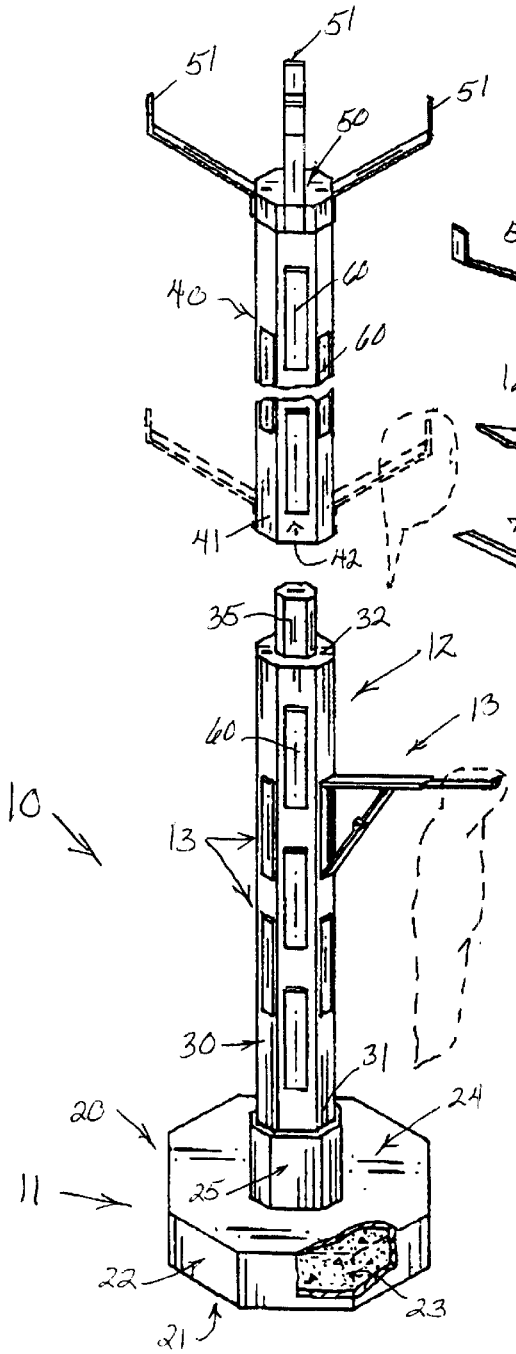
FIG. 1 is a partially exploded perspective view of the first version of the preferred embodiment of the expandable clothes support structure that forms the basis of this invention.

As can be seen by reference to the drawings, and in particular to FIG. 1, the expandable clothes support structure that forms the basis of the present invention is designated generally by the reference number 10. The structure 10 comprises in general, a base unit 11, a vertical support unit 12, and a plurality of movable support units 13. These units will now be described in seriatim fashion.

As shown in FIG. 1, in the first version of the preferred embodiment, the base unit 11 includes an enlarged base member 20 having a bottom panel 21 and raised sidewalls 22 which define an interior compartment 23 which contains dense material such as sand, gravel, lead weights, etc. for stabilizing purposes.

In addition, the enlarged base member 20 is provided with a top panel 24 having a centrally disposed hollow collar element 25 whose purpose and function will be described presently.

Figure 2:
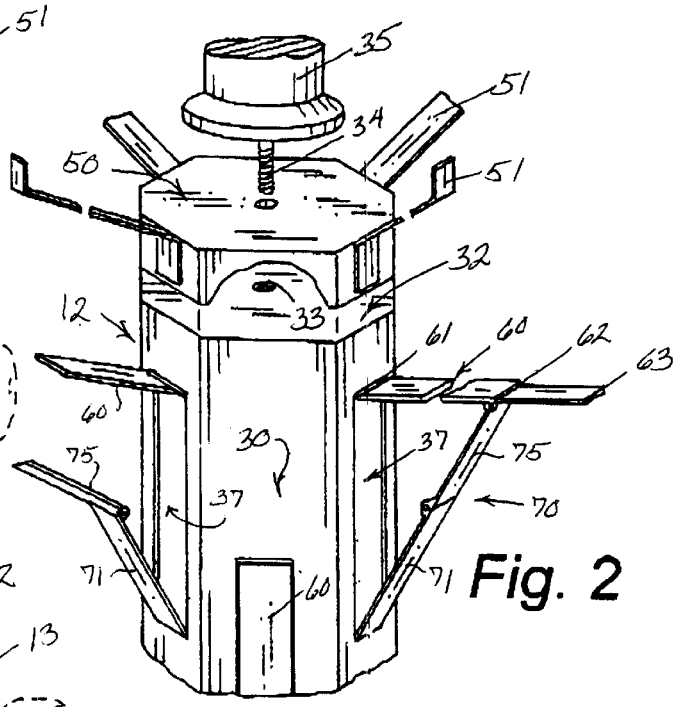
FIG. 2 is an enlarged detail view showing the threaded engagement of the optional adapter post element with the upper end of the main vertical support post member.

Turning now to FIGS. 1 and 2, it can be seen that the vertical support unit 12 comprises an elongated main support post member 30 having an enlarged diameter lower end 31 dimensioned to be received in the support collar element 25 of the base member 20 to maintain the main support post member 30 in a vertically upright position relative to the base member 20.

In addition, the main support post member 30 is further provided with a plurality of shallow recesses 37 and disposed around the periphery of the main support member 30, a reduced diameter generally flat upper end 32 provided with a threaded central aperture 33 which is dimensioned to receive a threaded screw 34 which depends downwardly from an adapter post element 35.

As shown in FIG. 1, the adapter post element 35 may be employed as a connector that is dimensioned to be received in a complementary recess 42 formed in the lower end 41 of an optional, auxiliary support post extension member 40, or in the alternative, the adapter post element 35 may be used to captively engage a cap element 50 having a plurality of rigid outwardly projecting prongs 51 to the upper ends 32, 42, respectively, of either the main support post member 30 or the auxiliary support post extension member 40 in a well recognized manner.

As shown in FIGS. 1 through 4, in the first version of the preferred embodiment each of the plurality of movable support units 13 comprise a main support arm member 60 having an inboard end 61 pivotally secured to the vertical support unit 12 and a hollow outboard end 62 which is dimensioned to receive an extension arm element 63 telescopically received within the main support arm member 60 and provided with a raised lip 64 on its outboard end. The raised lip 64 serves the dual function of providing a hook surface which will engage a portion of an article of clothing 100 which can be suspended from each support arm unit, as well as forming a gripping surface that will facilitate the extension and retraction of the extension arm element 63 relative to the support arm member 60.

Figure 3:
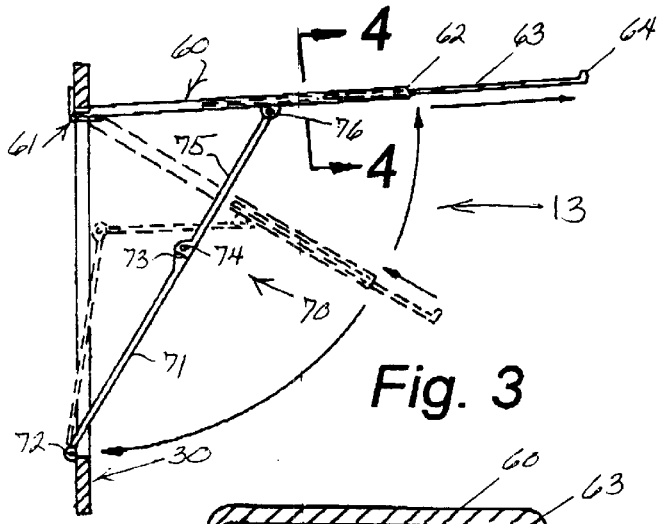
FIG. 3 is an isolated detail view of one of the support arm units.
Figure 4:
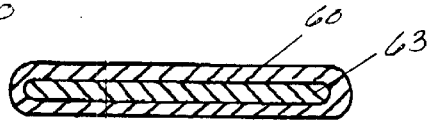
FIG. 4 is a cross sectional view taken through line 4—4 of FIG. 3.

In addition, as can best be seen by reference to FIG. 3, each of the support arm members 60 are provided with a collapsible brace element 70 having a lower brace segment 71 pivotally secured on its one end 72 to the main support post member 30 and pivotally secured on the other end 73 to the lower end 74 of an upper brace segment 75 whose other end 76 is pivotally secured to the underside of the support arm member 60.

Figure 5:
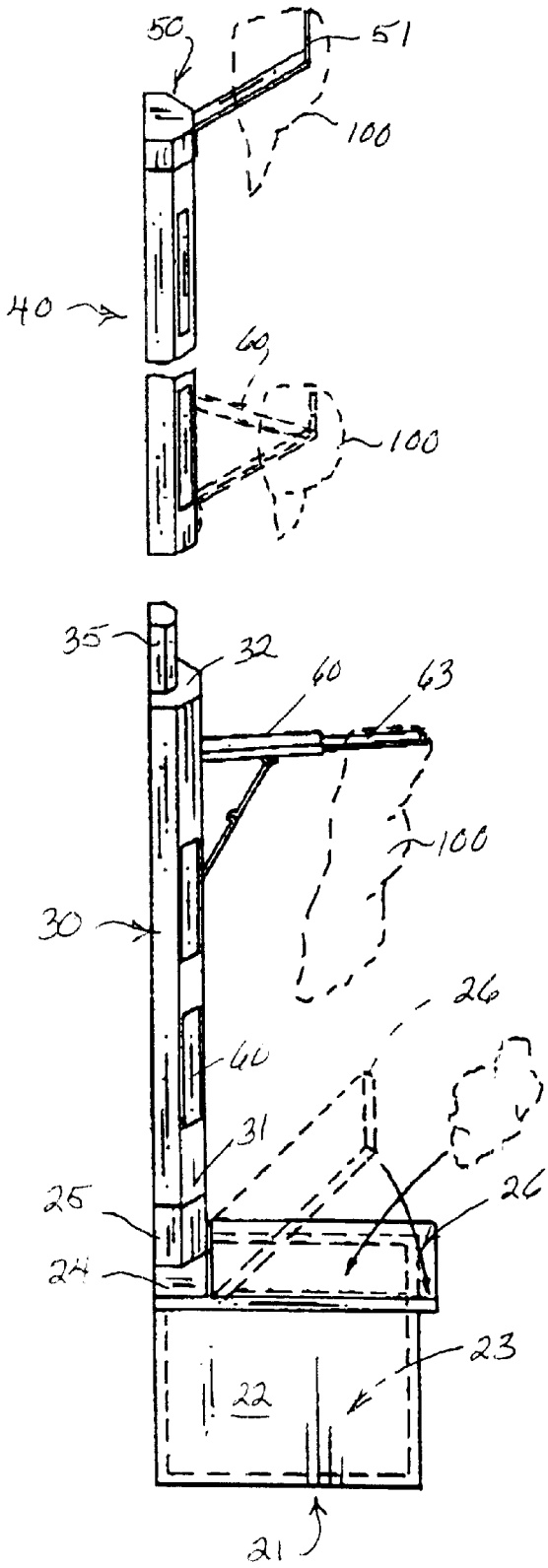
FIG. 5 is a partially exploded perspective view of an alternate version of the preferred embodiment of the expandable clothes support structure of this invention.
Figure 6:
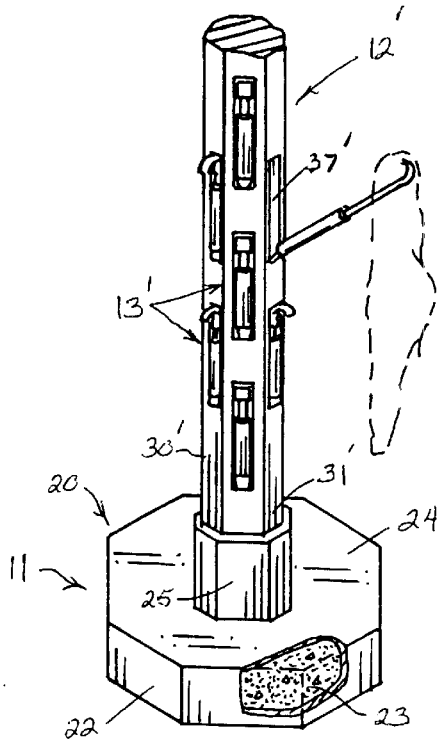
FIG. 6 is a perspective view of the second version of the preferred embodiment of the expandable clothes support structure that forms the basis of this invention.

In the alternate version of the first version of the preferred embodiment depicted in FIG. 5, it can be seen that the top panel 24 of the base member 20 is further provided with at least one hinged lid panel 26 so that the interior chamber 23 of the base member 20 may serve either as a storage compartment or hamper for articles of dirty clothes or as a container for wet or muddy boots and shoes.

At this juncture, it should be noted that the structure 10 is designed and intended to present an aesthetically pleasing appearance when not in use. All of the support arm member 60 are collapsed into their retracted storage mode and then only selected support arm members 60 will be pivoted outwardly to support and suspend a like number of articles of clothing 100 when needed.

Furthermore, the telescoping feature of each support arm member allows different articles of clothing 100 to be suspended at different lateral spacings relative to the exterior surface of the vertical support unit 12.

In the second version of the preferred embodiment depicted in FIGS. 6 through 11, it can be seen that the base unit 11 is identical to the base unit 11 of the first version, the vertical support unit 12' of the second version is only slightly different from the vertical support unit 12 of the first version and each of the movable support units 13' of the second version are substantially different from the movable support units 13 in the first version.

Figure 7:
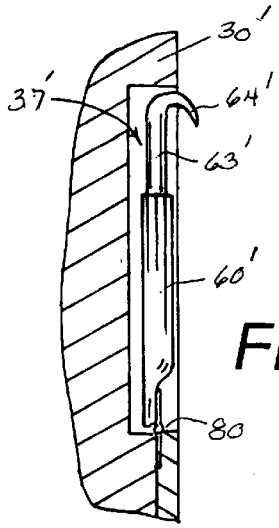
FIG. 7 is a cross sectional view showing one of the support arm units of the second version in the closed position.
Figure 8:
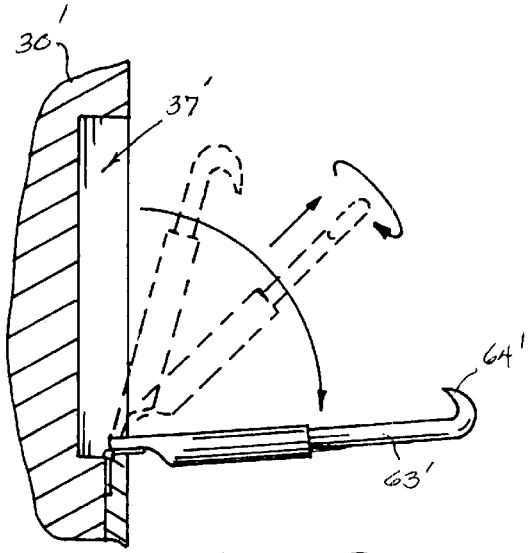
FIG. 8 is a cross sectional view showing the same support arm unit in the open position.
Figure 9:
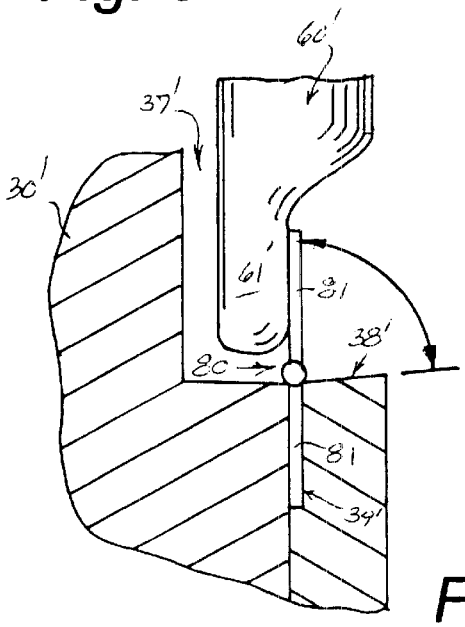
FIG. 9 is an enlarged detailed cross sectional view of the hinged connection between the vertical support unit and the support arm unit of the second version.

As can best be seen by reference to FIGS. 7 through 9, the vertical support unit 12' includes a main support post member 30' provided with a plurality of relatively deep recesses 37'. The lower portion of each of the recesses 37' are provided with a slightly angled shelf 38' and a vertical slot 39' whose purpose and function will be explained in greater detail further on in the specification.

As shown in FIGS. 7 through 10, each of the plurality of movable support arm units 13' in the second version of the preferred embodiment comprise a generally cylindrical main support arm member 60' having a tapered inboard end 61' connected to the upper plate 81 of a hinge member 80. The lower plate 82 of the hinge member 80 is fixedly secured within the vertical slot 39' in one of the recesses 37' in the main support post member 30'.

In addition, the main support arm member 60' is provided with a hollow outboard end 62' that is dimensioned to telescopically and rotatably receive a tubular extension arm element 63' having a raised lip 64 formed on its outboard end.

As can best be seen by reference to FIG. 11, the interior of the main support arm member 60' is provided with a pair of diametrically opposed inwardly directed protrusions 65' that are adapted to be engaged by a pair of curved wing elements 66' which project outwardly from the inboard end 67' of the extension arm element 63'. The protrusions 65' and the wing elements 66' cooperate with one another to allow the tubular extension arm element 63' to be rotated 180° relative to the main support arm member 60'.

Returning once more to FIGS. 6 through 9, it can be seen that the aforementioned relationship allows the raised lip 64' to be rotated downwardly so,that the raised lip 64' will project outwardly from the recesses 37' to allow each of the plurality of movable support units 13' to be retracted from the vertical support unit 12' and then the extension arm elements 63' can be rotated 180° relative to the main support arm member 60' so that the raised lip 64' functions as a clothes rack.

In addition, the angled shelf 38' at the front of each of the recesses 37' will cause each of the movable support units 13' to have a slightly upwardly angled cant when the movable support units are deployed in their outwardly projecting mode.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An expandable clothes support structure comprising:

a base unit including an enlarged base member;

a vertical support unit including a main vertical support post member having a lower end operatively associated with the base member and having an upper end;

a plurality of movable support units wherein each of the movable support units includes: a main support arm member having an inboard end pivotally associated with the main vertical support post member and having an outboard end; wherein the main vertical support post member is provided with a plurality of recesses dimensioned to receive at least a portion of the plurality of movable support units; wherein each of the plurality of recesses has a lower portion provided with an upwardly angled shelf and wherein, the outboard end of the main support arm member is hollow and further includes an extension arm element having an inboard end dimensioned to be telescopically received in said hollow outboard end.

2. The structure as in claim 1 wherein each extension arm element is further provided with an outboard end having an upturned lip.

3. The structure as in claim 1 wherein said enlarged base member includes a bottom panel provided with raised sidewalls which are connected to a top panel to define an interior compartment.

4. The structure as in claim 3 wherein said top panel is further provided with a hollow collar element dimensioned to receive the lower end of the main vertical support post member.

5. An expandable clothes support structure comprising:

a base unit including an enlarged base member;

a vertical support unit including a main vertical support post member having a lower end operatively associated with the base member and having an upper end;

a plurality of movable support units wherein each of the movable support units includes: a main support arm member having an inboard end connected to the main vertical support post member and having a hollow outboard end dimensioned to telescopically receive an extension arm element; wherein, the main vertical support post member is provided with a plurality of recesses dimensioned to receive at least a portion of the plurality of movable support units; and wherein, each of said plurality of recesses has a lower portion provided with an upwardly angled shelf.

6. The structure as in claim 5 wherein the extension arm element has an inboard end slidably received within the hollow outboard end of the main support arm member and having an outboard end provided with a lip.

7. The structure as in claim 6 wherein the inboard end of the main support arm member is pivotally secured to the main vertical support post member.

8. The structure as in claim 5 wherein, the inboard end of each of the main support arm members are adapted to rest on the upwardly angled shelf within each recess.

9. The structure as in claim 6 wherein the extension arm element is also rotatably received within the outboard end of the main support arm member.

10. The structure as in claim 9 further including:

means for limiting the rotational movement of the extension arm element relative to the main support arm member to an arc of rotation of approximately 180°.

* * * * *